US007113715B2

(12) United States Patent
Yang et al.

(10) Patent No.: US 7,113,715 B2
(45) Date of Patent: Sep. 26, 2006

(54) METHOD AND APPARATUS TO PREVENT A TRANSFER ROLLER FROM BEING CONTAMINATED IN IMAGE FORMING SYSTEMS

(76) Inventors: Cheol-ju Yang, 308-907 Green mansion, 276 Bon-dong, Dalseo-gu, Daego Metropolitan-City (KR); Jun-bae Jeon, 104 Galaxy Town, 317-3 Yangjae-dong, Scoecho-gu, Seoul (KR)

( * ) Notice: Subject to any disclaimer, the term of this patent is extended or adjusted under 35 U.S.C. 154(b) by 70 days.

(21) Appl. No.: 10/986,987

(22) Filed: Nov. 15, 2004

(65) Prior Publication Data

US 2005/0105925 A1 May 19, 2005

(30) Foreign Application Priority Data

Nov. 14, 2003 (KR) ..... 10-2003-0080772

(51) Int. Cl.
*G03G 15/08* (2006.01)
*G03G 15/16* (2006.01)

(52) U.S. Cl. ..... 399/66; 399/45; 399/121; 399/297; 399/389

(58) Field of Classification Search ..... 399/45, 399/66, 121, 297, 301, 302, 313, 389
See application file for complete search history.

(56) References Cited

U.S. PATENT DOCUMENTS 5,506,660 A * 4/1996 Rabb et al. ..... 399/66
5,689,760 A * 11/1997 Suzuki et al. ..... 399/45
6,295,424 B1 9/2001 Regelsberger
2005/0008381 A1 * 1/2005 Aono et al. ..... 399/45

FOREIGN PATENT DOCUMENTS

| | | |
|---|---|---|
| JP | 56-059277 | 5/1981 |
| JP | 59-118640 | 7/1984 |
| JP | 61-282858 | 12/1986 |
| JP | 61-282859 | 12/1986 |

* cited by examiner

*Primary Examiner*—Arthur T. Grimley
*Assistant Examiner*—Joseph S. Wong

(57) ABSTRACT

A method and apparatus to prevent a transfer roller from being contaminated by toner in an image forming system, the method comprising setting a print region for a scanning operation according to a comparison result between a previous paper size in a paper cassette and a paper size in a driver; determining a current paper size in the paper cassette based on a time when front and rear ends of the paper are detected by a paper feeding sensor; comparing the current paper size in the paper cassette with the paper size in the driver; and if the paper size in the driver size is larger than the paper size in the paper cassette and the print region for the previous paper size in the paper cassette has not been set, determining a separation time of a transfer roller from a transfer belt in consideration of a delay time when the transfer roller is mechanically separated from the transfer belt after a separation command is applied to the transfer roller.

33 Claims, 10 Drawing Sheets

METHOD AND APPARATUS TO PREVENT A TRANSFER ROLLER FROM BEING CONTAMINATED IN IMAGE FORMING SYSTEMS

CROSS-REFERENCE TO RELATED APPLICATIONS

This application claims priority from Korean Patent Application Nos. 2003-80772, filed on Nov. 14, 2003, in the Korean Intellectual Property Office, the disclosure of which is incorporated herein by reference and in its entirety.

BACKGROUND OF THE INVENTION

1. Field of the Invention

The present general inventive concept relates to an image forming system, and more particularly, to a method and apparatus to prevent a transfer roller from being contaminated by toner in an image forming system when the size of paper set in a printer driver is different from the size of paper supplied from a paper feeding cassette.

2. Description of the Related Art

In an electrophotographic image forming system, when an exposure unit radiates light onto a photosensitive medium charged to a predetermined potential, an electrostatic latent image is formed on the photosensitive medium. Thereafter, a developing unit forms a toner image by supplying toner to the electrostatic latent image. In general, a color electrophotographic image forming system needs four developing units in which four color toners, such as cyan (C), magenta (M), yellow (Y), and black (B), are respectively stored. The toner image is transferred onto paper directly from the photosensitive medium or via an intermediate transfer medium. When the transferred toner image passes a fusing unit, the toner image is fused on the paper by heat and pressure. A single color or multiple color image is printed on the paper through the above procedure.

As a basic rule for the above image forming system, paper having a size appropriate for the size of an image to be formed on the photosensitive medium is supplied according to printing conditions set in a printer driver. However, in some cases, paper of an appropriate size for the size of the image cannot be supplied. When the size of the image is smaller than the size of the paper, printing problems do not occur. However, when the size of the image is larger than the size of the paper, toner corresponding to portions from the toner image formed on the photosensitive medium is transferred to a transfer roller. As a result, a next sheet of paper becomes contaminated, or a transfer bias potential of the transfer roller is substantially reduced, causing transfer defects.

In order to solve these problems, in conventional printers, the transfer roller is cleaned by changing a polarity used during an image transfer operation and transferring toner attached onto the transfer roller on the photosensitive medium before and after a printing operation is performed on new paper. However, this added step increases the amount of time required for driving the system. As such, the life span of the system may be reduced, and an entire time required for a printing operation may increase. Additionally, when the size of paper set in the printer driver is different from the size of paper supplied from a paper feeding cassette, jamming occurs and the printing operation is stopped. As such, additional efforts and time are needed to return to a printable state. In addition, since it is determined whether the size of the paper set in the printer driver is different from the size of the paper supplied from the paper feeding cassette after a first sheet of paper has been printed, when the size of an image is larger than the size of the paper, the transfer roller is contaminated by a toner image that has been previously formed on a transfer belt.

SUMMARY OF THE INVENTION

The present general inventive concept provides a method and apparatus to prevent a transfer roller from being contaminated by toner in an image forming system when the size of paper set in a printer driver is different from the size of paper supplied from a paper feeding cassette, and an image forming system using the method and apparatus.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept are achieved by providing a method of preventing contamination of a transfer roller in an image forming system, the method comprising setting a print region for a scanning operation according to a comparison result between a previous paper size in a paper cassette and a paper size in a driver; determining a current paper size in the paper cassette based on a time when front and rear ends of the paper are detected by a paper feeding sensor; comparing the current paper size in the paper cassette with the paper size in the driver; setting a separation time of a transfer roller from a transfer belt as a first or second time period based on a time when the rear end of the paper has passed by the paper feeding sensor according to a comparison between the paper size in the driver and the current paper size in the paper cassette and the print region for the scanning operation; and if the time when the rear end of the paper has passed through the paper feeding sensor reaches the separation time of the transfer roller, separating the transfer roller from the transfer belt.

The foregoing and/or other aspects and advantages of the present general inventive concept are also achieved by providing a method of preventing contamination of a transfer roller in an image forming system, the method comprising setting a print region for a scanning operation according to a comparison result between a previous paper size in a paper cassette and a paper size in a driver; determining a current paper size in the paper cassette based on a time when front and rear ends of the paper are detected by a paper feeding sensor; comparing the current paper size in the paper cassette with the paper size in the driver; setting a separation time of a transfer roller from a transfer belt as a first or second time period based on a time when the front end of the paper has passed by the transfer roller according to a comparison between the paper size in the driver and the current paper size in the paper cassette and the print region for the scanning operation; and if the time when the front end of the paper has passed through the transfer roller reaches the separation time of the transfer roller, separating the transfer roller from the transfer belt.

The foregoing and/or other aspects and advantages of the present general inventive concept are also achieved by providing an apparatus to prevent contamination of a transfer roller in an image forming system, the apparatus comprising a storage unit storing a previous paper size in a paper cassette; a print region setting unit setting a print region for a scanning operation according to a comparison result between the previous paper size in the paper cassette and a paper size in a driver; a paper size determination unit determining a current paper size in the paper cassette based on a time when front and rear ends of the paper are detected by a paper feeding sensor; a comparison unit comparing the current paper size in the paper cassette with the paper size in the driver; and a controller determining a separation time of a transfer roller from a transfer belt in consideration of a delay time when the transfer roller is mechanically separated from the transfer belt after a separation command is applied to the transfer roller, according to a comparison between the paper size in the driver and the current paper size in the paper cassette and the print region for the scanning operation.

The foregoing and/or other aspects and advantages of the present general inventive concept are also achieved by providing a multipass color image forming system comprising a controller adapted to perform the following operations: setting a print region for a scanning operation according to a comparison result between a previous paper size in a paper cassette and a paper size in a driver; determining a current paper size in the paper cassette based on a time when front and rear ends of the paper are detected by a paper feeding sensor; comparing the current paper size in the paper cassette with the paper size in the driver; and if the paper size in the driver is larger than the paper size in the paper cassette and the print region for the previous paper size in the paper cassette has not been set, determining a separation time of a transfer roller from a transfer belt in consideration of a delay time when the transfer roller is mechanically separated from the transfer belt after a separation command is applied to the transfer roller.

The method may be implemented using a computer readable medium on which a program to execute the method in a computer is recorded.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which:

FIGS. 7A and 7B illustrate the transfer roller separation mechanism when the size of the image is larger than the size of the paper to be printed on.

DETAILED DESCRIPTION OF THE PREFERRED EMBODIMENTS

Figure 1:
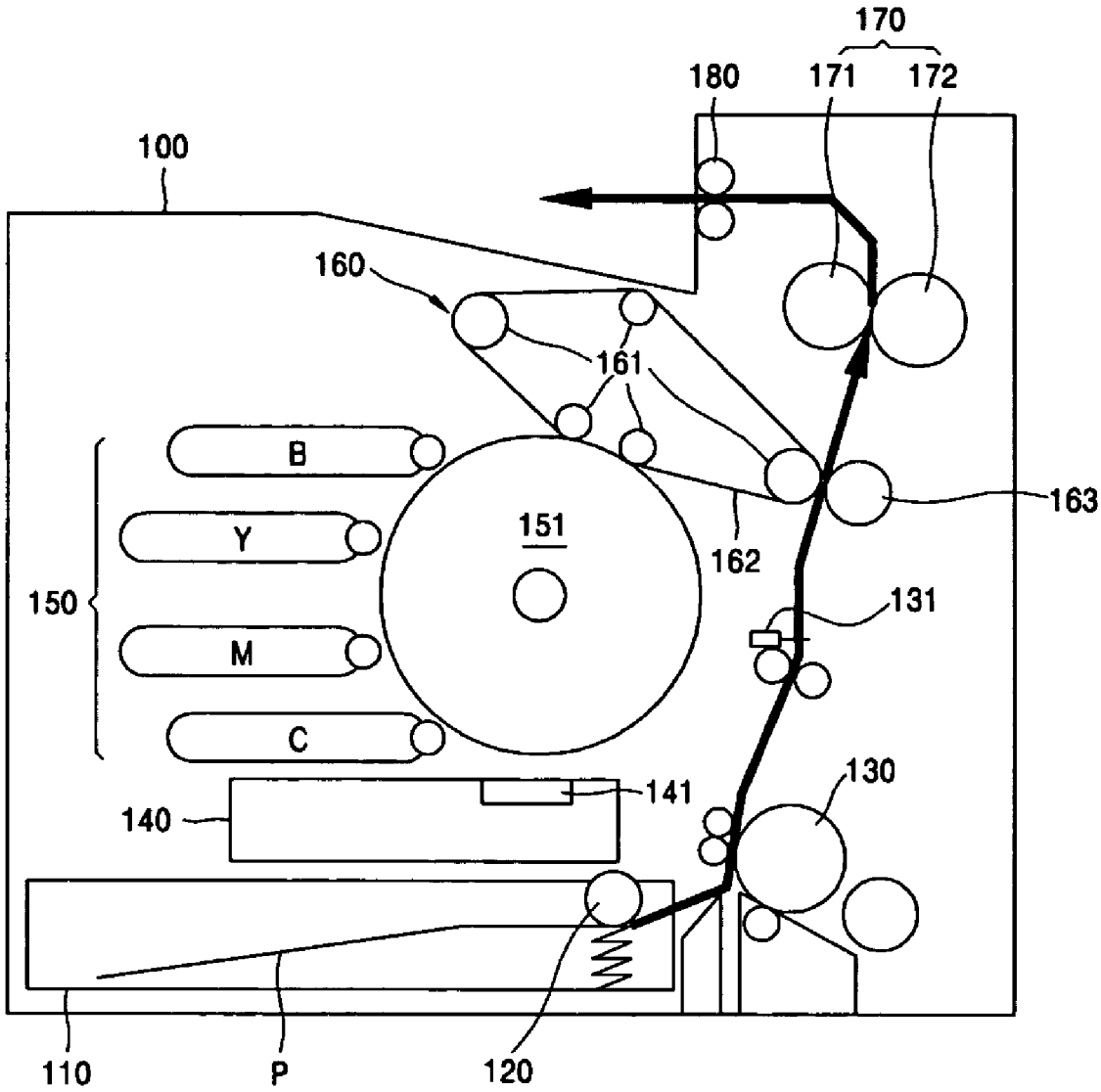
FIG. 1 is a side cross-sectional view illustrating a mechanism of an image forming system using a method of preventing a transfer roller from being contaminated, according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a side cross-sectional view illustrating a mechanism of an image forming system using a method of preventing a transfer roller from being contaminated, according to an embodiment of the present general inventive concept. The image forming system includes a stacking unit 110, a pickup unit 120, a paper feeding unit 130, an exposure unit 140, a developing unit 150, a transfer unit 160, a fusing unit 170, and a paper exhausting unit 180.

Referring to FIG. 1, the stacking unit 110, generally a paper feeding cassette, can be installed in a lower portion of a main body 100, to be attached to or detached from the main body 100, and paper P is stacked therein. The paper P is picked-up by the pickup unit 120, which is rotatably installed in the main body 100, and transferred within the main body 100 generally in the direction of the arrow.

The pickup unit 120, generally a pickup roller, picks up the paper P from the stacking unit 110 (or paper cassette). The paper feeding unit 130, generally a paper feeding roller, transfers the paper P picked-up from the stacking unit 110 inside the main body 100. A paper feeding sensor 131 detects a front and/or rear end of the paper P, and senses whether pickup of the paper P from the stacking unit 110 has been successfully performed by the pickup unit 120 according to a detection result of the front and/or rear end of the paper P In this case, the paper feeding sensor 131 is illustrated as being placed at a location adjacent to a transfer roller 163, but may be placed at different locations as well.

The exposure unit 140 radiates light corresponding to an image signal on a photosensitive drum 151 charged to have a uniform potential to form an electrostatic latent image. In general, the exposure unit 140 is a laser scanning unit (LSU) using a laser diode as a light source. In this case, a light window 141 is opposite to the photosensitive drum 151. A laser beam from the laser diode is radiated through light window 141 onto the photosensitive drum 151.

The developing unit 150 comprises a plurality of ink cartridges adapted to contact the photosensitive drum 151 so as to develop the electrostatic latent image formed on the surface of the photosensitive drum 151 by the exposure unit 140, as a predetermined color image, in response to the image signal. A developing agent stored in the plurality of ink cartridges is used to form a predetermined visible image while being superimposed on the electrostatic latent image formed on the photosensitive drum 151. A method of forming a color image by repeatedly performing exposure, development, and transfer operations for each color using an exposure unit 140 and a photosensitive drum 151 is referred to as a multipass method.

The transfer unit 160 can include a transfer belt 162, which is supported by a plurality of transfer belt backup rollers 161 and rotated in a closed loop and on which the toner image formed on the surface of the photosensitive drum 151 is transferred. The transfer unit 160 further includes a transfer roller 163, which is installed to be opposite to one of the plurality of transfer belt backup rollers 161. The transfer belt 162 is usually placed between one of the plurality of transfer belt backup rollers 161 and the transfer roller 163, where the transfer roller 163 presses the paper P toward the transfer belt 162. Thus, a color toner image transferred from the photosensitive drum 151 to the transfer belt 162 is transferred onto the paper P. The traveling linear velocity of the transfer belt 162 is preferably the same as a rotation linear velocity of the photosensitive drum 151. In addition, the length of the transfer belt 162 is preferably the same as or longer than the length of the paper P in which the color toner image is finally received. In the transfer unit 160, the transfer roller 163 is installed to be opposite to the transfer belt 162. The transfer roller 163 is separated from the transfer belt 162 by a solenoid (not shown) while the color toner image is being transferred to the transfer belt 162. When the color toner image is completely transferred to the transfer belt 162, the transfer roller 163 moves toward the transfer belt 162 to press the paper P at a predetermined pressure against the transfer belt 162, so as to transfer the color toner image onto the paper P.

The fusing unit 170 includes a fusing roller 171 which generates heat, and a pressing roller 172 which is installed opposite the fusing roller 171. The paper P is placed between the fusing roller 171 and the pressing roller 172, where the pressing roller 172 presses the paper P toward the fusing roller 171. The fusing roller 171 applies heat to the paper P in which the visible image is formed, and fuses the visible image onto the paper P.

The paper exhausting unit 180, generally a paper exhausting roller, exhausts the paper P in which the visible image is formed to an outside of the main body 100. In order to perform printing on both sides of the paper P, the paper exhausting unit 180 is also reversed. As such, the paper P can be reversely rotated and transferred to a reversal path.

Figure 2:
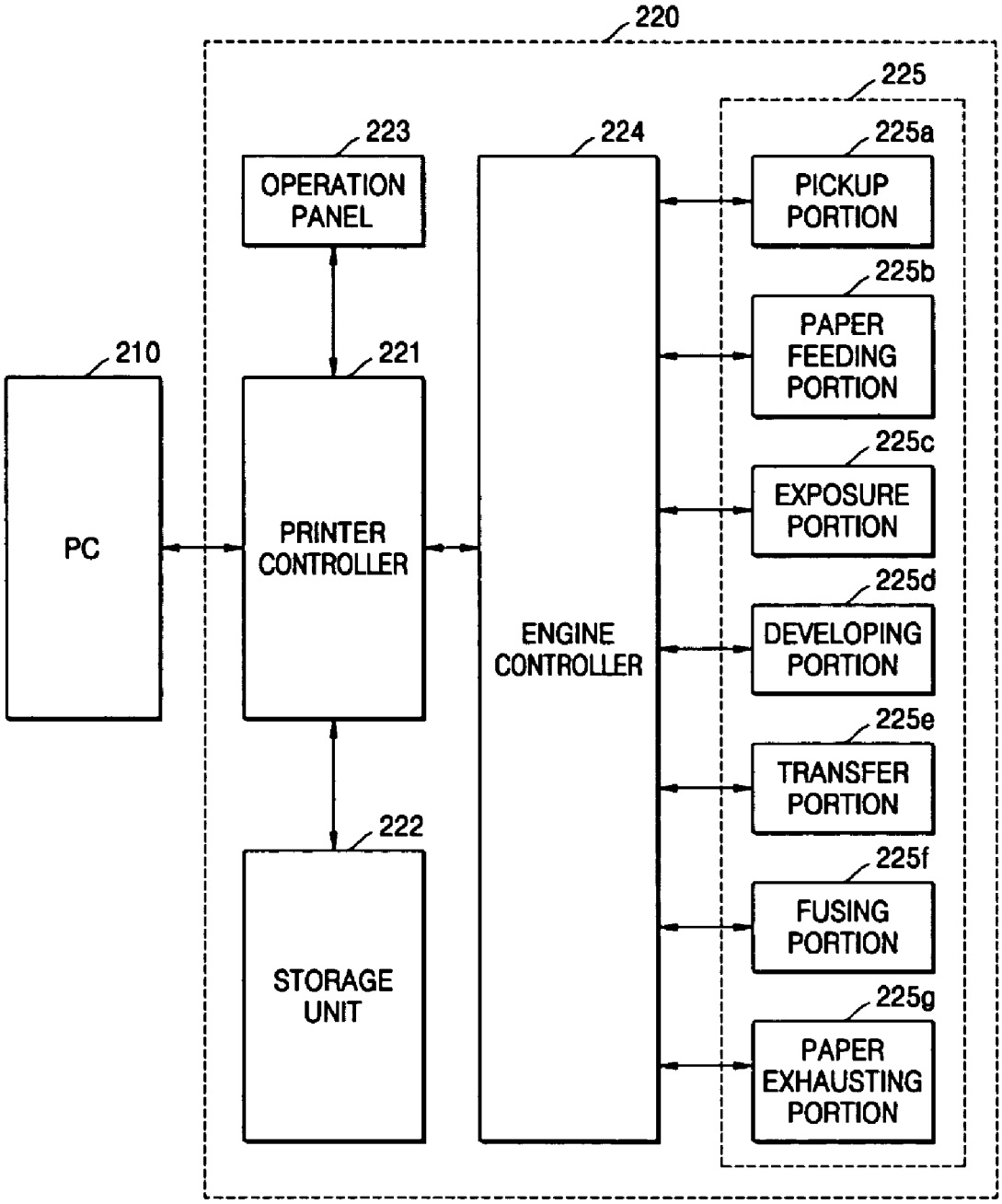
FIG. 2 is a functional block diagram illustrating a function of the image forming system to perform the method of preventing a transfer roller from being contaminated, according to an embodiment of the present general inventive concept.

FIG. 2 is a functional block diagram illustrating operations of an image forming system 220 to perform the method of preventing a transfer roller from being contaminated. The image forming system 220 includes a printer controller 221, a storage unit 222, an operation panel 223, an engine controller 224, and an engine unit 225.

Referring to FIG. 2, the printer controller 221 converts a printing data received from an external source, e.g., from a computer (PC) 210 connected to a communication interface, into image data appropriate to drive the engine unit 225 according to printing conditions set in a printer driver (not shown) and to store the image data in the storage unit 222.

The storage unit 222 stores various control programs required to implement the operations of the image forming system 220, various data generated in the printer controller 221 by performing the control programs, the printing data received from the PC 210, and printing information temporarily.

The operation panel 223 includes a key matrix and a display. The key matrix generates data according to keys pressed by a user to designate each mode and to perform an operation in a designated mode, and outputs the data to the printer controller 221. The display displays the operational state of the system when the printer controller 221 executes each mode.

The engine controller 224 controls the engine unit 225 so that an image corresponding to the image data received from the printer controller 221 is printed on the paper P. For this purpose, when a printing instruction command is received from the printer controller 221, the engine controller 224 controls the engine unit 225 so that each of portions 225*a*–225*g* of the engine unit 225 is prepared to perform a printing operation. An example of printing operation preparation is to rotate a polygonal rotating mirror or a scan disc, which is a deflection unit of an exposure portion 225*c*, at a predetermined speed required during the printing operation, or to heat a fusing portion 225*f* to a predetermined temperature, or to check whether something is wrong with each device that performs the printing operation. Thus, after the printing instruction command has been received from the printer controller 221, when it is determined that the printing operation can be performed after a printing preparation time, the engine controller 224 controls the engine unit 225 to apply a printing starting signal to the printer controller 221 and to supply an image data stored in the storage unit 222 to the exposure portion 225*c* via the engine controller 224.

The engine unit 225 includes various portions required for the printing operation. For example, in the case of the electrophotographic image forming system, the engine unit 225 includes a pickup portion 225*a*, a paper feeding portion 225*b*, an exposure portion 225*c*, a developing portion 225*d*, a transfer portion 225*e*, a fusing portion 225*f*, and a paper exhausting portion 225*g*, as shown in FIG. 2. In this way, the engine unit 225 may be formed in various shapes according to a printing method.

Figure 3A:
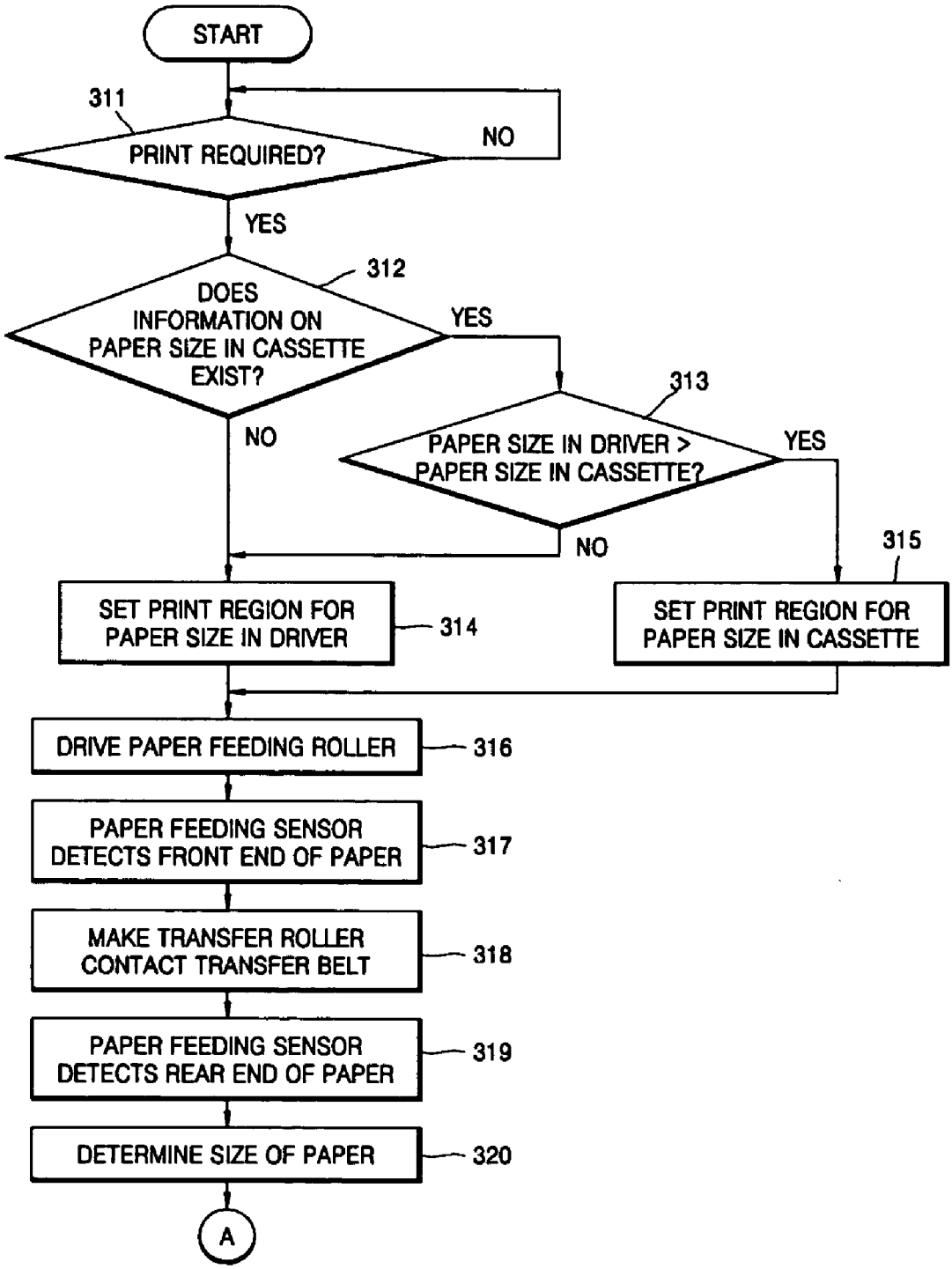
FIGS. 3A and 3B are flowcharts illustrating a method to prevent a transfer roller from being contaminated in an image forming system, according to an embodiment of the present general inventive concept.
Figure 3B:
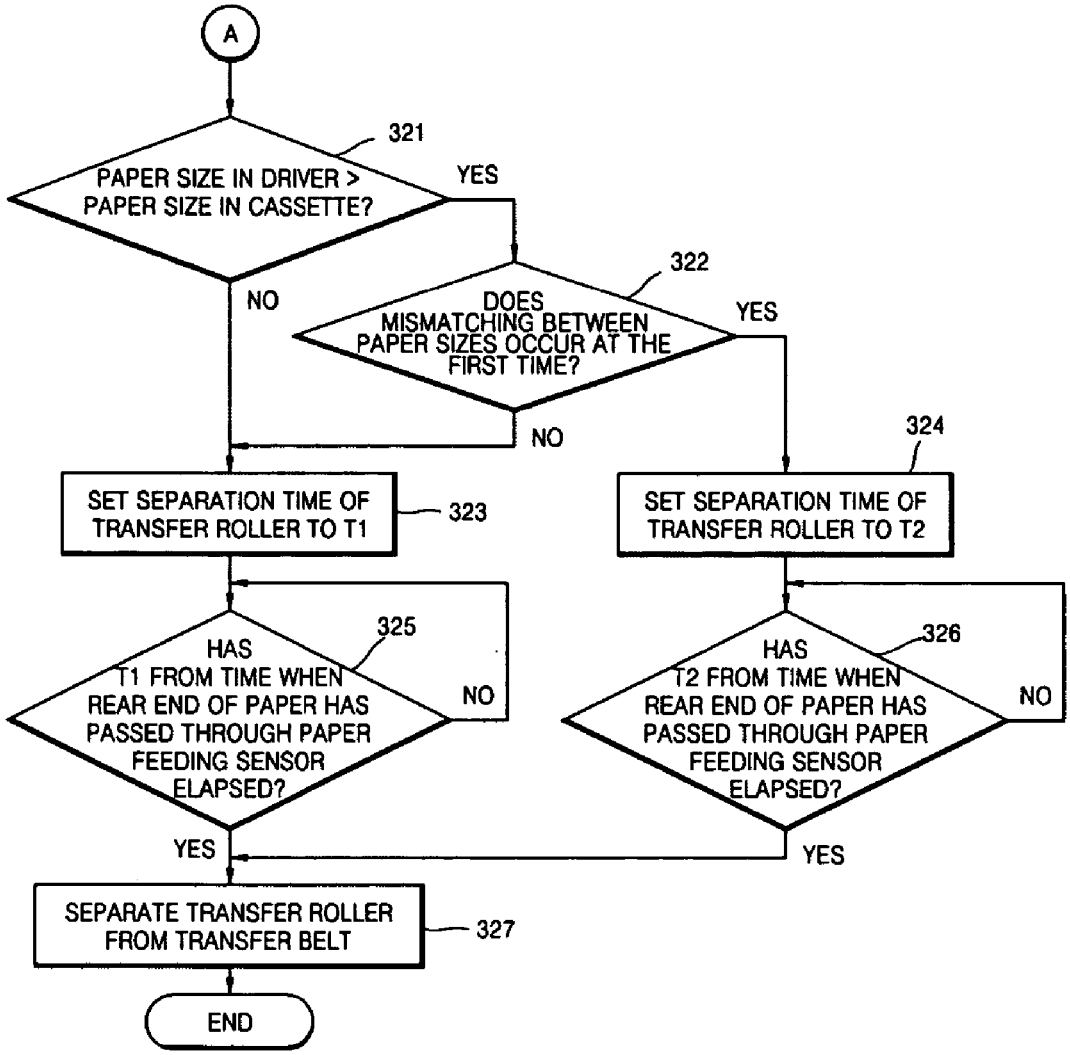

FIGS. 3A and 3B are flowcharts illustrating a method of preventing a transfer roller from being contaminated, according to an embodiment of the present general inventive concept. The method of preventing a transfer roller from being contaminated comprises setting a print region (operations 311 through 315), determining the size of paper in a paper feeding cassette (operations 316 through 320), setting a separation time of the transfer roller 163 from the transfer belt 162 according to a comparison result of the size of the paper in the paper feeding cassette (hereinafter, referred as a paper size in the cassette) and the size of an image (hereinafter, referred as a paper size in the driver) and a setting result of the print region (operations 321 through 324), and separating the transfer roller 163 from the transfer belt 162 when the separation time of the transfer roller 163 has elapsed (operations 325 through 327). Each of the operations can be programmed as code segments performed in the printer controller 221 or an additional processor and will be described with reference to FIGS. 1 and 2.

Referring to FIGS. 3A and 3B, in operation 311, it is monitored whether a print command is given from the PC 210. When the print command is given, it is determined in operation 312 whether information on a previous paper size in the cassette has been stored a storage medium. When the information on the previous paper size in the paper cassette has been stored, a comparison between the previous paper size in the cassette and the paper size in the driver is performed in operation 313. Information on the paper size in the driver, that is, the size of an image formed on the photosensitive drum 151, is provided in advance from the PC 210.

When the information on the previous paper size in the cassette has not been stored in operation 312 or the previous paper size in the cassette is determined to be larger than the paper size in the driver in operation 313 a print region on the photosensitive drum 151 is set corresponding to the paper size in the driver, in operation 314. Information on a print region, that is, the scanning length in a primary scanning direction and the scanning length in a secondary scanning direction on the photosensitive drum 151 for each paper size is included in the form of, for example, a look-up table in the firmware of the print controller 221. That is, in operation 314, information on the paper size in the driver is provided to the firmware of the print controller 221 and the print region for the paper size in the driver is set. The scanning operation in the exposure portion 225*c* of the engine unit 225 is performed depending on the print region.

When the previous paper size in the cassette is determined to be equal to or smaller than the paper size in the driver in operation 313, a print region on the photosensitive drum 151 is set corresponding to the previous paper size in the cassette and a flag indicating the setting of the print region for the previous paper size in the cassette is set as number 1, in operation 315. That is, in operation 315, information on the paper size in the cassette is provided to the firmware of the print controller 221 and the print region for the paper size in the cassette is set. The scanning operation in the exposure portion 225*c* of the engine unit 225 is performed depending on the print region.

In operation 316, the paper feeding unit 130 such as a paper feeding roller, is driven, and in operation 317, a front end of a paper is detected by the paper feeding sensor 131. When a color toner image is completely transferred to the transfer belt 162 from the photosensitive drum 151, the transfer roller 163 contacts the transfer belt 162 at a predetermined pressure, so as to transfer the color toner image onto the paper P, in operation 318. In operation 319, a rear end of paper is detected by the paper feeding sensor 131. In operation 320, the current paper in the cassette is determined using the time when the front end of the paper is detected by the paper feeding sensor 131 and the time when the rear end of the paper is detected by the paper feeding sensor 131. In general, the size of the paper is determined by the length of the paper moving in the transfer direction, but the length cannot be directly measured. Thus, the paper feeding sensor 131 can be placed at a location adjacent to the paper feeding unit 130 such as the paper feeding roller, on a transfer path of the paper, or at a location adjacent to the transfer roller 163. When the front end of the paper is detected by the paper feeding sensor 131, a timer starts operating, and when the rear end of the paper is detected by the paper feeding sensor 131, the timer stops operating. In this way, the length of the paper in the paper transfer direction (i.e., the length of the paper in a secondary scanning direction) is determined by a detection time when the front and rear ends of the paper are detected by the paper feeding sensor 131. After the length in the paper transfer direction is determined, the width (i.e., the length of the paper in a primary scanning direction) may be determined based on the standard size of the paper.

In operation 321, the paper size in the driver is compared with the current paper size in the cassette, which is determined in operation 320. As a comparison result of operation 321, when the paper size in the driver, i.e., the size of the image formed on the photosensitive drum 151, is larger than the current paper size in the cassette, it is determined in operation 322 whether a mismatching between the paper size in the cassette and the paper size in the driver occurs at the first time, that is, the print region for the previous paper size in the cassette has not been set. This operation is achieved by checking a value of the flag set in operation 315.

As a comparison result of operation 321, when the paper size in the driver is equal to or smaller than the current paper size in the cassette, or as a checking result of operation 322, when the paper size in the driver is larger than the current paper size in the cassette and the print region for the previous paper size in the cassette has been set, the separation time of the transfer roller 163 is set to a first predetermined time T1, in operation 323. The first predetermined time T1 is set to a time period from a time when the rear end of the paper has passed by the paper feeding sensor 131 to a time when the rear end of the paper reaches a nip of the transfer roller 163. The first predetermined time T1 may be different according to a distance between the paper feeding sensor 131 and the nip of the transfer roller 163 and a printing speed. The first predetermined time T1 can be stored in advance in a database by the size of paper according to the type of an image forming apparatus.

Meanwhile, as a checking result of operation 322, when the paper size in the driver is greater than the current paper size in the cassette and the print region for the previous paper size in the cassette has not been set, the separation time of the transfer roller 163 is set to a second predetermined time T2, in operation 324. In this case, the second predetermined time T2 is smaller than the first predetermined time T1 and is determined according to a distance between the paper feeding sensor 131 and the nip of the transfer roller 163 and a printing speed and in consideration of a delay time $T_d$ when the transfer roller 163 is mechanically separated from the transfer belt 162 after a separation command is given from the engine controller 224. Additionally, a safety factor, that is, a mechanical tolerance α, may be further considered in the determination of the second predetermined time T2. In this case, the second predetermined time T2 is given by Equation 1 below.

$$T2=T1-\alpha T_d \quad (1)$$

By setting the second predetermined time T2 as above, the transfer roller 163 is prevented from being contaminated by an image longer (in the length direction) than the size of the paper stacked in the paper feeding cassette and transferred to the transfer belt 162.

In operation 325, when the paper size in the driver is equal to or smaller than the current paper size in the cassette, or when the paper size in the driver is larger than the current paper size in the cassette and the print region for the previous paper size in the cassette has been set, it is determined whether the first predetermined time T1 has elapsed from a time when the rear end of the paper has passed by the paper feeding sensor 131. As a determination result of operation 325, when the first predetermined time T1 has elapsed, the transfer roller 163 is separated from the transfer belt 162 in operation 327. Meanwhile, in operation 326, when the paper size in the driver is greater than the current paper size in the cassette and the print region for the previous paper size in the cassette has not been set, it is determined whether the second predetermined time T2 has elapsed from the time when the rear end of the paper has passed by the paper feeding sensor 131. As a determination result of operation 326, when the second predetermined time T2 has elapsed, the transfer roller 163 is separated from the transfer belt 162, in operation 327.

After operation 327, the paper is normally fused and exhausted through the fusing unit 170 and the paper exhausting unit 180, and the printing operation is terminated.

The above-described method is applied to an embodiment in which a transfer operation has been already performed on the transfer belt 162 from the photosensitive drum 151 at a time when the size of the paper stacked in the paper feeding cassette is determined. However, the method may be applied to an embodiment in which the transfer operation has not yet been performed on the transfer belt 162 from the photosensitive drum 151 at the time when the size of the paper stacked in the paper feeding cassette is determined. In addition, the method may be applied to a multipass color image forming apparatus to form a complete image by superimposing each color image on a medium, such as an intermediate transfer belt, after outputting all of color video data.

Figure 4:
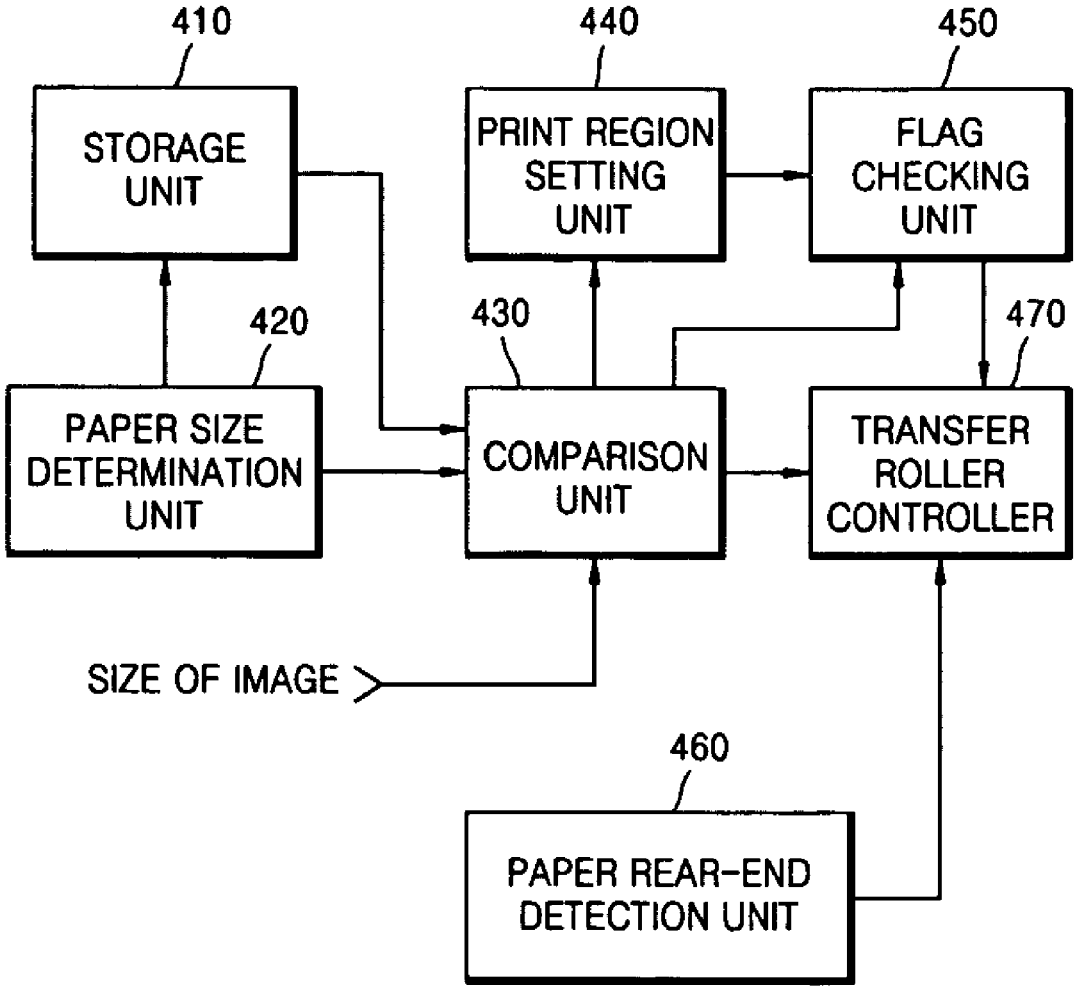
FIG. 4 is a block diagram illustrating a structure of an apparatus to prevent a transfer roller from being contaminated in an image forming system, according to an embodiment of the present general inventive concept.

FIG. 4 is a block diagram illustrating a structure of an apparatus to prevent a transfer roller from being contaminated, according to an embodiment of the present general inventive concept. The apparatus to prevent a transfer roller from being contaminated according to the embodiment of FIG. 4 includes a storage unit 410, a paper size determination unit 420, a comparison unit 430, a print region setting unit 440, a flag checking unit 450, a paper rear-end detection unit 460, and a transfer roller controller 470.

Referring to FIG. 4, the storage unit 410 stores information on the paper size in cassette, as described previously.

The paper size determination unit 420 determines the size of the paper from a time when front and rear ends of the paper picked-up from the paper feeding cassette are detected by the paper feeding sensor 131.

In the comparison unit 430, a first region setting signal is provided to the print region setting unit 440 according to whether the information on the previous paper size in the cassette has been stored in the storage unit 410. In the comparison unit 430, the first or a second region setting signal is provided to the print region setting unit 440 according to a comparison result between the previous paper size in the cassette and the paper size in the driver. In the comparison unit 430, a first separation control signal is provided to the transfer roller controller 470 according to a comparison result between the current paper size in the cassette and the paper size in the driver.

In the print region setting unit 440, a print region for a scanning operation is set according to one of the first and the second region setting signals provided from the comparison unit 430 and when the print region for the previous paper size in the cassette is set, a flag indicating this is set to number 1. When it is determined that the paper size in the driver is larger than the paper size in the cassette in the comparison unit 430, the flag checking unit 450 checks the flag set in the print region setting unit 440, and provides the first separation control signal or a second separation control signal to the transfer roller controller 470 according to a checking result of the flag.

The paper rear-end detection unit 460 supplies a time when the rear end of the paper is detected by the paper feeding sensor 131 to the transfer roller controller 470.

The transfer roller controller 470 stores in advance a first predetermined time T1 and a second predetermined time T2 as a separation time of the transfer roller 163 from the transfer belt 162. The transfer roller controller 470 determines the first predetermined time T1 or the second predetermined time T2 as a separation time of the transfer roller 163 from the transfer belt 162 according to the first separation control signal provided from the comparison unit 430 or the first or second separation control signal provided from the flag checking unit 450. When the first separation control signal from the comparison unit 430 or the flag checking unit 450 is provided to the transfer roller controller 470, the transfer roller controller 470 determines whether the first predetermined time T1 has elapsed from a time when the rear end of the paper has passed by the paper feeding sensor 131. When the first predetermined time T1 has elapsed, the transfer roller controller 470 applies a command to separate the transfer roller 163 from the transfer belt 162 to the engine controller 224. Meanwhile, when the second separation control signal from the flag checking unit 450 is provided to the transfer roller controller 470, the transfer roller controller 470 determines whether the second predetermined time T2 has elapsed from the time when the rear end of the paper has passed by the paper feeding sensor 131. When the second predetermined time T2 has elapsed, the transfer roller controller 470 applies the command to separate the transfer roller 163 from the transfer roller 162 to the engine controller 224.

Figure 5A:
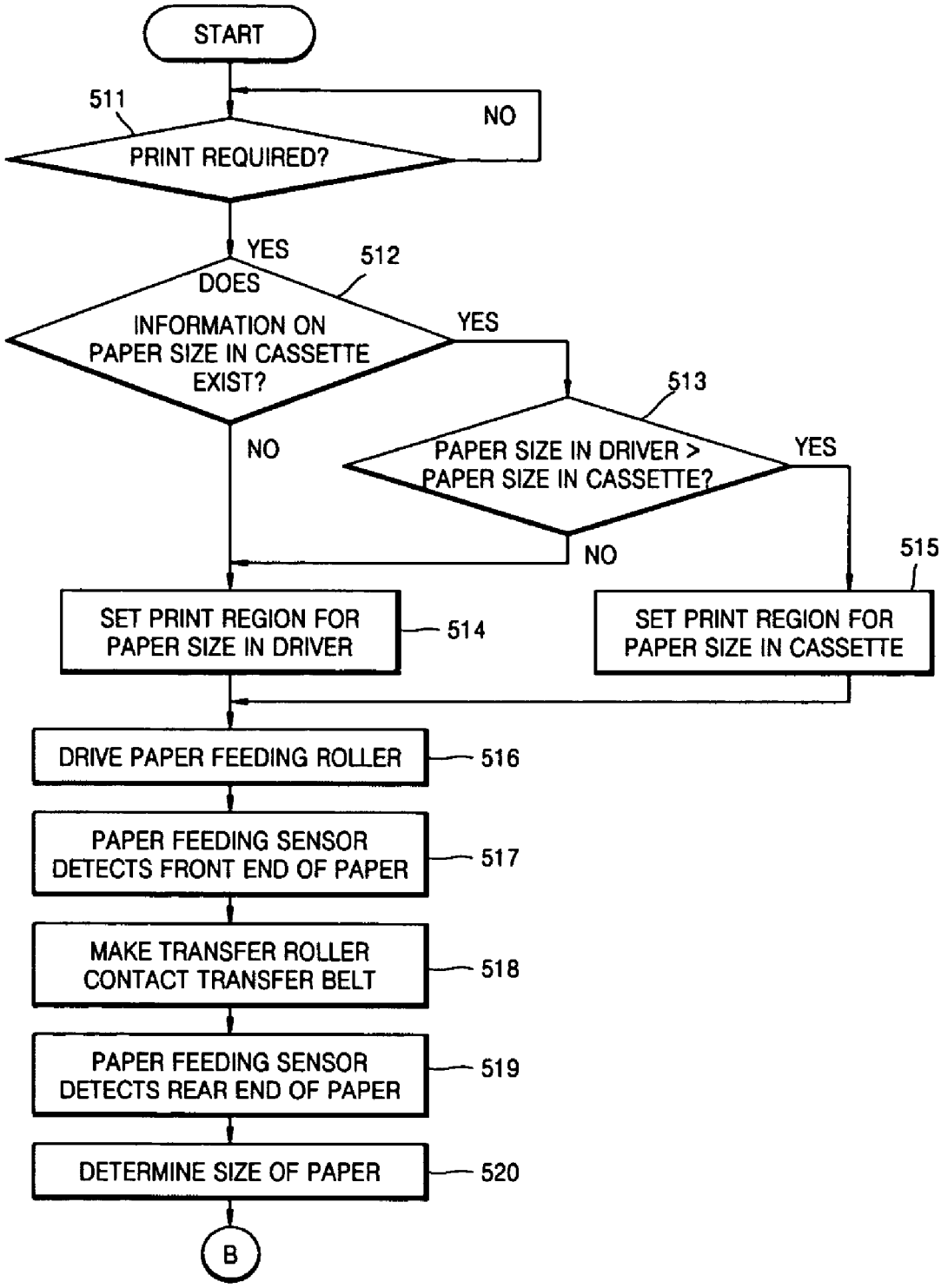
FIGS. 5A and 5B are flowcharts illustrating a method of preventing a transfer roller from being contaminated, according to another embodiment of the present general inventive concept.
Figure 5B:
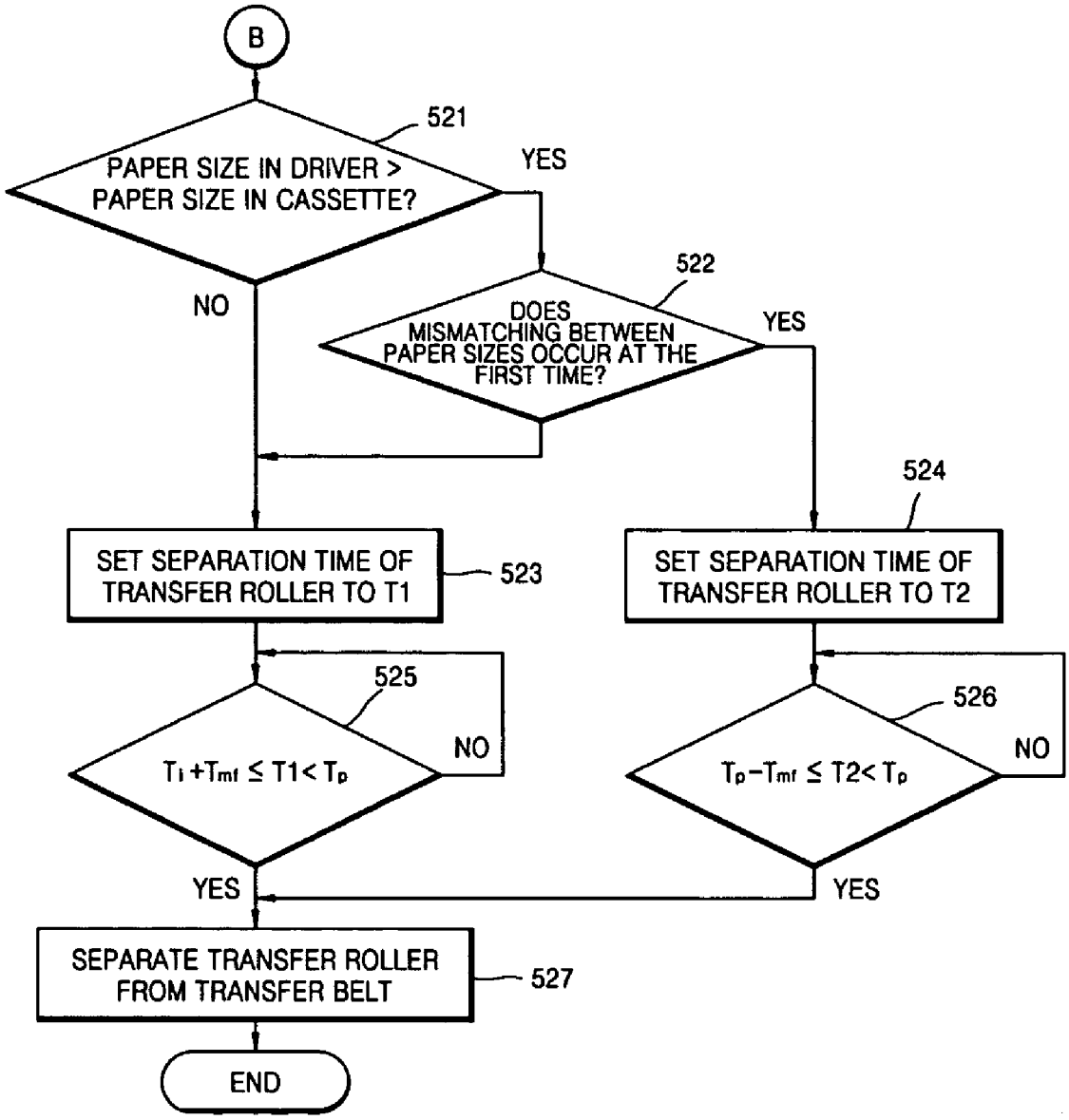

FIGS. 5A and 5B are flowcharts illustrating a method of preventing a transfer roller from being contaminated, according to another embodiment of the present general inventive concept. The method of preventing a transfer roller from being contaminated according to this embodiment comprises setting a print region (operations 511 through 515), determining the size of paper of a paper feeding cassette (operations 516 through 520), setting a separation time of the transfer roller 163 according to a comparison result of the size of the paper of the paper feeding cassette (hereinafter, referred as a paper size in the cassette) and the size of an image (hereinafter, referred as a paper size in the driver) and a setting result of the print region (operations 521 through 524), and separating the transfer roller 163 from the transfer belt 162 when the separation time of the transfer roller 163 has elapsed (operations 525 through 527). The present embodiment is applied to the embodiment of FIG. 1 regardless of the location of the paper feeding sensor 131. Only portions different from the embodiment shown in FIGS. 3A and 3B will be described with reference to FIGS. 6A, 6B, 7A, and 7B.

Figure 6A:
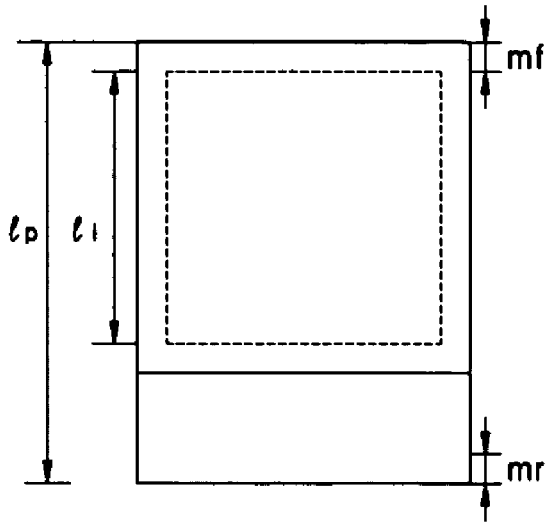
FIGS. 6A and 6B illustrate a transfer roller separation mechanism when the size of paper to be printed on is larger than the size of an image.
Figure 6B:
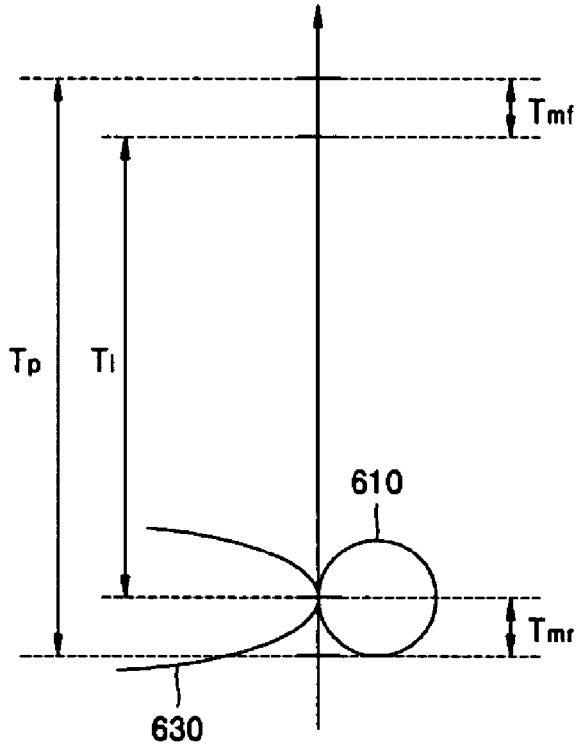
Figure 7A:
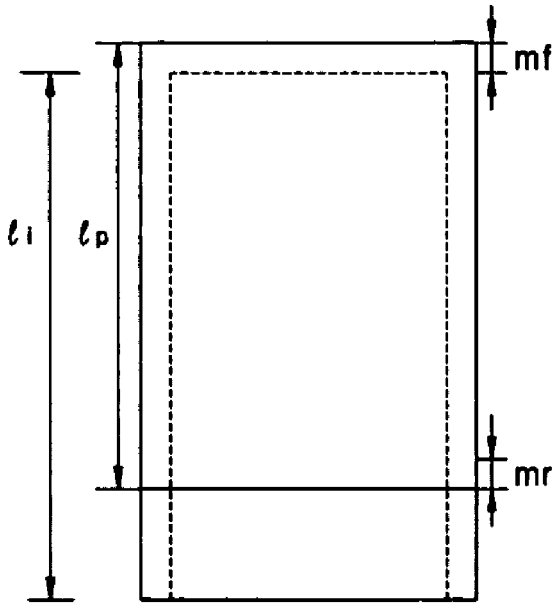
Figure 7B:
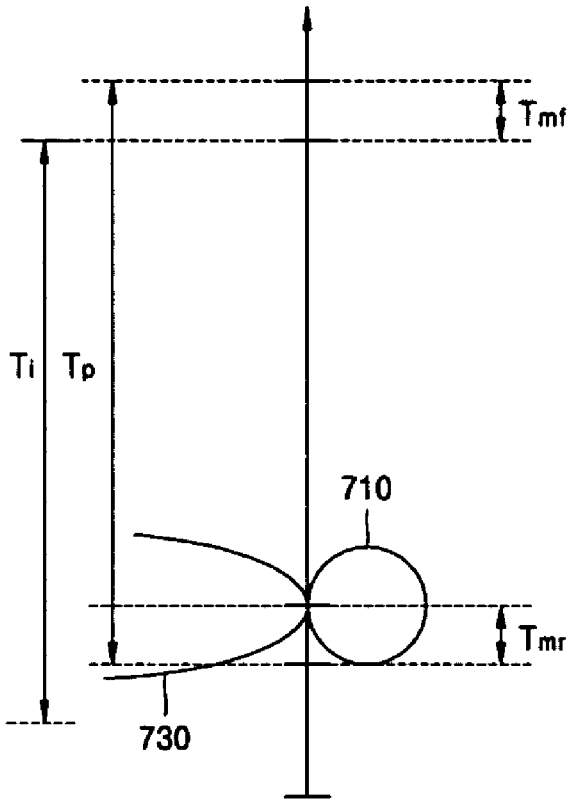

FIGS. 6A and 6B show a transfer roller separation mechanism when the size of paper is larger than the size of an image, and FIGS. 7A and 7B show the transfer roller separation mechanism when the size of the image is larger than the size of the paper. In FIGS. 6A and 7A, $l_p$ is the length of the paper, $l_i$ is the length of the image, mf is an upper end page margin, and mr is a lower end page margin. In FIGS. 6B and 7B, $T_p$ is a time taken to transfer the paper having the length of $l_p$, $T_i$ is a time taken to print the image having the length of $l_i$, $T_{mf}$ is a time taken to obtain the upper end page margin mf, and $T_{mr}$ is a time taken to obtain the lower end page margin mr.

Referring back to FIGS. 5A and 5B, as a comparison result of operation 521, when the paper size in the driver is equal to or smaller than the current paper size in the cassette, or as a checking result of operation 522, when the paper size in the driver is larger than the current paper size in the cassette and the print region for the previous paper size in the cassette has been set, the separation time of the transfer roller 163 is set to a first predetermined time T1, in operation 523. The first predetermined time T1 may be stored in advance in a database by the size of paper according to the type of an image forming apparatus, and is given by Equation 2 below.

$$T_i+T_{mf}\leqq T1<T_p \tag{2}$$

$T_p$ is a time taken to transfer the paper having the length of $l_p$, $T_i$ is a time taken to print the image having the length of $l_i$, and $T_{mf}$ is a time taken to obtain the upper end page margin mf. In this case, since the length $l_i$ of the image is the same as or smaller than the length ($l_p$-mr) obtained by subtracting the lower end page margin mr from the length $l_p$ of the paper, the transfer roller 163 is not contaminated by toner without considering a delay time $T_d$ when the transfer roller 163 is mechanically separated from the transfer belt 162 after a separation command is given from the engine controller 224.

Meanwhile, as a checking result of operation 522, when the paper size in the driver is larger than the current paper size in the cassette and the print region for the previous paper size in the cassette has been set, the separation time of the transfer roller 163 is set to a second predetermined time T2 in operation 524. The second predetermined time T2 may be stored in advance in the database by the size of paper according to the type of an image forming apparatus, and is given by Equation 3 below.

$$T_p - T_{mr} \leqq T2 < T_p \quad (3)$$

$T_p$ is a time taken to transfer the paper having the length of $l_p$, and $T_{mr}$ is a time taken to obtain the upper end page margin mr.

The delay time $T_d$ when the transfer roller 163 is mechanically separated from the transfer belt 162 after a separation command is given from the engine controller 224 may be considered, and a safety factor, that is, a mechanical tolerance α, may be further considered in the determination of the second predetermined time T2. In this case, the second predetermined time T2 is given by Equation 4 below.

$$T_p - T_{mr} - \alpha T_d \leqq T2 < T_p - \alpha T_d \quad (4)$$

By setting the second predetermined time T2 as provided above, the transfer roller 163 is prevented from being contaminated by an image longer than the size of the paper stacked in the paper feeding cassette and transferred to the transfer belt 162.

In operation 525, when the paper size in the driver is equal to or smaller than the current paper size in the cassette, or when the paper size in the driver is larger than the current paper size in the cassette and the print region for the previous paper size in the cassette has been set, it is determined whether the counted time, from a time when the front end of the paper has passed by the transfer roller 163, falls within the first predetermined time T1. As a determination result of operation 525, when the counted time falls within the first predetermined time T1, a command to separate the transfer roller 163 from the transfer belt 162 is applied to the engine controller 224 in operation 527.

Meanwhile, in operation 526, when the paper size in the driver is larger than the current paper size in the cassette and the print region for the previous paper size in the cassette has been set, it is determined whether the counted time, from the time when the front end of the paper has passed by the transfer roller 163, falls within the second predetermined time T2. As a determination result of operation 526, when the counted time falls within the second predetermined time T2, the command to separate the transfer roller 163 from the transfer belt 162 is applied to the engine controller 224 in operation 527.

Figure 8:
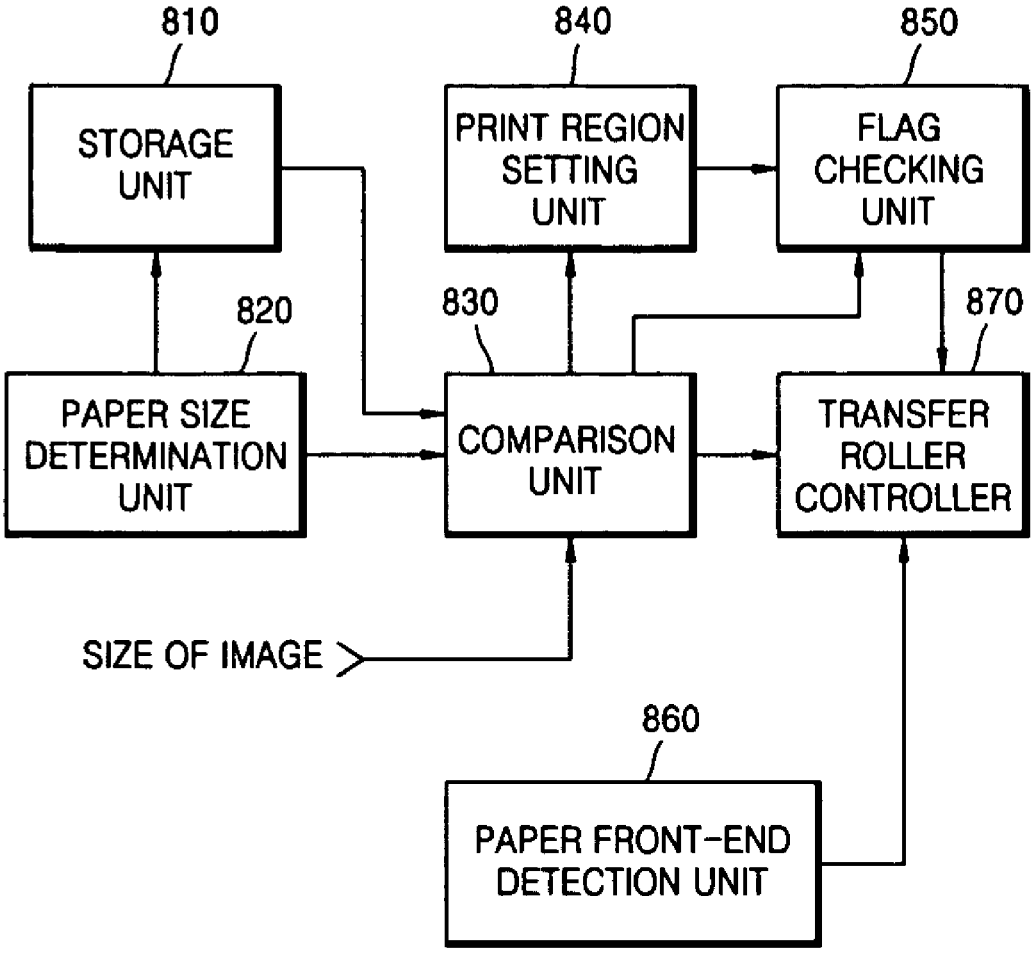
FIG. 8 is a block diagram illustrating a structure of an apparatus to prevent a transfer roller from being contaminated, according to another embodiment of the present general inventive concept.

FIG. 8 is a block diagram illustrating a structure of an apparatus to prevent a transfer roller from being contaminated, according to another embodiment of the present general inventive concept. The apparatus to prevent a transfer roller from being contaminated includes a storage unit 810, a paper size determination unit 820, a comparison unit 830, a print region setting unit 840, a flag checking unit 850, a paper front-end detection unit 860, and a transfer roller controller 870.

Referring to FIG. 8, the storage unit 810 stores information on the paper size in cassette determined previously.

The paper size determination unit 820 determines the size of paper from a time when front and rear ends of the paper picked-up from a paper feeding cassette are detected by the paper feeding sensor 131.

In the comparison unit 830, a first region setting signal is provided to the print region setting unit 840 according to whether the information on the previous paper size in cassette has been stored in the storage unit 810. In the comparison unit 830, the first or a second region setting signal is provided to the print region setting unit 840 according to a comparison result between the previous paper size in the cassette and the paper size in the driver. In the comparison unit 830, a first separation control signal is provided to the transfer roller controller 870 according to a comparison result between the current paper size in the cassette and the paper size in the driver.

In the print region setting unit 840, a print region for a scanning operation is set according to one of the first and the second region setting signals provided from the comparison unit 830 and when the print region for the previous paper size in the cassette is set, a flag indicating this is set to number 1. When it is determined that the paper size in the driver is larger than the paper size in the cassette in the comparison unit 830, the flag checking unit 850 checks the flag set in the print region setting unit 840, and provides the first separation control signal or a second separation control signal to the transfer roller controller 870 according to a checking result of the flag.

The paper front-end detection unit 860 supplies a time when the front end of the paper is detected by a nip of the transfer roller 163 to the transfer roller controller 870.

The transfer roller controller 870 stores in advance a first predetermined time T1 and a second predetermined time T2 as a separation time of the transfer roller 163 from the transfer belt 162. The transfer roller controller 870 determines the first predetermined time T1 or the second predetermined time T2 as a separation time of the transfer roller 163 from the transfer belt 162 according to the first separation control signal provided from the comparison unit 830 or the first or second separation control signal provided from the flag checking unit 850. When the first separation control signal from the comparison unit 830 or the flag checking unit 850 is provided to the transfer roller controller 870, the transfer roller controller 870 determines whether the counted time from a time when the front end of the paper has passed through the nip of the transfer roller 163 falls within the first predetermined time T1. When the counted time falls within the first predetermined time T1, the transfer roller controller 870 applies a command to separate the transfer roller 163 from the transfer belt 162 to the engine controller 224. Meanwhile, when the second separation control signal from the flag checking unit 850 is provided to the transfer roller controller 870, the transfer roller controller 870 determines whether the counted time from a time when the front end of the paper has passed through the nip of the transfer roller 163 falls within the second predetermined time T2. When the counted time falls within the second predetermined time T2, the transfer roller controller 870 applies the command to separate the transfer roller 163 from the transfer roller 162 to the engine controller 224.

The general inventive concept can also be embodied as computer readable codes on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, optical data storage devices, and carrier waves (such as data transmission through the Internet). The computer readable recording medium can also be distributed over network coupled computer systems so that the computer readable code is stored and executed in a distributed fashion. Also, functional programs, codes, and code segments accomplishing the present general inventive concept can be easily construed by programmers skilled in the art to which the present general inventive concept pertains.

As described above, the present general inventive concept is applied to the structure of a multipass color image forming apparatus without a paper size sensor, and when the size of paper set in a printer driver (the size of an image formed on a photosensitive drum) is larger than the size of paper stacked in a paper feeding cassette and a print region for a paper size in the cassette has not been set, a transfer roller is separated from a transfer belt before the transfer roller is contaminated by toner, such that the transfer roller is prevented from being contaminated by toner.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A method of preventing contamination of a transfer roller in an image forming system, the method comprising:

setting a print region for a scanning operation according to a comparison result between a previous paper size in a paper cassette and a paper size in a driver;

determining a current paper size in the paper cassette based on a time when front and rear ends of the paper are detected by a paper feeding sensor;

comparing the current paper size in the paper cassette with the paper size in the driver; and if the paper size in the driver is larger than the paper size in the paper cassette and the print region for the previous paper size in the paper cassette has not been set, determining a separation time of a transfer roller from a transfer belt in consideration of a delay time when the transfer roller is mechanically separated from the transfer belt after a separation command is applied to the transfer roller.

2. The method of claim 1, wherein the separation time of the transfer roller is determined by further considering a mechanical tolerance.

3. The method of claim 1, wherein if information on the previous paper size in the paper cassette does not exist or the previous paper size in the paper cassette is equal to or larger than the paper size in the driver, the print region for the paper size in the driver is set.

4. The method of claim 1, wherein if the previous paper size in the paper cassette is smaller than the paper size in the driver, the print region for the previous paper size in the paper cassette is set.

5. The method of claim 1, wherein the method is applied to a structure of a multipass color image forming apparatus.

6. A method of preventing contamination of a transfer roller in an image forming system, the method comprising:

setting a print region for a scanning operation according to a comparison result between a previous paper size in a paper cassette and a paper size in a driver;

determining a current paper size in the paper cassette based on a time when front and rear ends of the paper are detected by a paper feeding sensor;

comparing the current paper size in the paper cassette with the paper size in the driver;

setting a separation time of a transfer roller from a transfer belt as a first or second time period based on a time when the rear end of the paper has passed through the paper feeding sensor according to a comparison between the paper size in the driver and the current paper size in the paper cassette and the print region for the scanning operation; and if the time when the rear end of the paper has passed through the paper feeding sensor reaches the separation time of the transfer roller, separating the transfer roller from the transfer belt.

7. The method of claim 6, wherein the first time period is set when the paper size in the driver is equal to or smaller than the current paper size in the cassette, or when the paper size in the drive is larger than the current paper size in the paper cassette and the print region for the previous paper size in the paper cassette has been set and is determined according to a distance between the paper feeding sensor and the transfer roller and a printing speed.

8. The method of claim 6, wherein the second time period is set when the paper size in the driver is larger than the current paper size in the paper cassette and the print region for the previous paper size in the paper cassette has not been set and is determined according to a distance between the paper feeding sensor and the transfer roller and a printing speed and in consideration of a delay time when the transfer roller is mechanically separated from the transfer belt after a separation command is applied to the transfer roller.

9. The method of claim 8, wherein the second time period is determined by further considering a mechanical tolerance.

10. The method of claim 6, wherein the method is applied to a structure of a multipass color image forming apparatus.

11. A method of preventing contamination of a transfer roller in an image forming system, the method comprising:

setting a print region for a scanning operation according to a comparison result between a previous paper size in a paper cassette and a paper size in a driver;

determining a current paper size in the paper cassette based on a time when front and rear ends of the paper are detected by a paper feeding sensor;

comparing the current paper size in the paper cassette with the paper size in the driver;

setting a separation time of a transfer roller from a transfer belt as a first or second time period based on a time when the front end of the paper has passed through the transfer roller according to a comparison between the paper size in the driver and the current paper size in the paper cassette and the print region for the scanning operation; and if the time when the front end of the paper has passed the transfer roller reaches the separation time of the transfer roller, separating the transfer roller from the transfer belt.

12. The method of claim 11, wherein the first time period T1 is set when the paper size in the driver is equal to or smaller than the current paper size in the paper cassette, or when the paper size in the drive is larger than the current paper size in the paper cassette and the print region for the previous paper size in the paper cassette has been set and is given by:

$$T_i+T_{mf}\leqq T1<T_p$$

where $T_p$ is a time taken to transfer the paper having the length of $l_p$, $T_i$ is a time taken to print the image having the length of $l_i$, and $T_{mf}$ is a time taken to obtain an upper end page margin.

13. The method of claim 11, wherein the second time period T2 is set when the paper size in the drive is larger than the current paper size in the paper cassette and the print region for the previous paper size in the paper cassette has not been set and is given by:

$$T_p - T_{mr} \leqq T2 < T_p$$

where $T_p$ is a time taken to transfer the paper having the length of $l_p$, and $T_{mr}$ is a time taken to obtain a lower upper end page margin.

14. The method of claim 11, wherein the second time period T2 is set when the paper size in the driver is larger than the current paper size in the paper cassette and the print region for the previous paper size in the paper cassette has not been set and is given by:

$$T_p - T_{mr} - \alpha T_d \leqq T2 < T_p - \alpha T_d$$

where $T_p$ is a time taken to transfer the paper having the length of $l_p$, $T_{mr}$ is a time taken to obtain a lower end page margin, $T_d$ is a delay time when the transfer roller is mechanically separated from the transfer belt after a separation command is applied to the transfer roller, and $\alpha$ is a mechanical tolerance.

15. The method of claim 11, wherein the method is applied to a structure of a multipass color image forming apparatus.

16. A computer readable recording medium containing instructions adapted to control an image forming system to prevent contamination of a transfer roller, the instructions comprising:

a first set of instructions adapted to control the image forming system to set a print region for a scanning operation according to a comparison result between a previous paper size in a paper cassette and a paper size in a driver;

a second set of instructions adapted to control the image forming system to determine a current paper size in the paper cassette based on a time when front and rear ends of the paper are detected by a paper feeding sensor;

a third set of instructions adapted to control the image forming system to compare the current paper size in the paper cassette with the paper size in the driver; and if the paper size in the driver is larger than the paper size in the paper cassette and the print region for the previous paper size in the paper cassette has not been set, a fourth set of instructions adapted to control the image forming system to determine a separation time of a transfer roller from a transfer belt in consideration of a delay time when the transfer roller is mechanically separated from the transfer belt after a separation command is applied to the transfer roller.

17. A computer readable recording medium containing instructions adapted to control an image forming system to prevent contamination of a transfer roller, the instructions comprising:

a first set of instructions adapted to control the image forming system to set a print region for a scanning operation according to a comparison result between a previous paper size in a paper cassette and a paper size in a driver;

a second set of instructions adapted to control the image forming system to determine a current paper size in the paper cassette based on a time when front and rear ends of the paper are detected by a paper feeding sensor;

a third set of instructions adapted to control the image forming system to compare the current paper size in the paper cassette with the paper size in the driver;

a fourth set of instructions adapted to control the image forming system to set a separation time of a transfer roller from a transfer belt as a first or second time period based on a time when the rear end of the paper has passed by the paper feeding sensor according to a comparison between the paper size in the driver and the current paper size in the paper cassette and the print region for the scanning operation; and if the time when the rear end of the paper has passed by the paper feeding sensor reaches the separation time of the transfer roller, a fifth set of instructions adapted to control the system to separate the transfer roller from the transfer belt.

18. A computer readable recording medium containing instructions adapted to control an image forming system to prevent contamination of a transfer roller comprising:

a first set of instructions adapted to control the image forming system to set a print region for a scanning operation according to a comparison result between a previous paper size in a paper cassette and a paper size in a driver;

a second set of instructions adapted to control the image forming system to determine a current paper size in the paper cassette based on a time when front and rear ends of the paper are detected by a paper feeding sensor;

a third set of instructions adapted to control the image forming system to compare the current paper size in the paper cassette with the paper size in the driver;

a fourth set of instructions adapted to control the image forming system to set a separation time of a transfer roller from a transfer belt as a first or second time period based on a time when the front end of the paper has passed by the transfer roller according to a comparison between the paper size in the driver and the current paper size in the paper cassette and the print region for the scanning operation; and if the time when the front end of the paper has passed by the transfer roller reaches the separation time of the transfer roller, a fifth set of instructions adapted to control the system to separate the transfer roller from the transfer belt.

19. An apparatus to prevent contamination of a transfer roller in an image forming system, the apparatus comprising:

a storage unit to store a previous paper size in a paper cassette;

a print region setting unit to set a print region for a scanning operation according to a comparison result between the previous paper size in the paper cassette and a paper size in a driver;

a paper size determination unit to determine a current paper size in the paper cassette based on a time when front and rear ends of the paper are detected by a paper feeding sensor;

a comparison unit to compare the current paper size in the paper cassette with the paper size in the driver; and a controller to determine a separation time of a transfer roller from a transfer belt in consideration of a delay time when the transfer roller is mechanically separated from the transfer belt after a separation command is applied to the transfer roller, according to a comparison between the paper size in the driver and the current paper size in the paper cassette and the print region for the scanning operation.

20. The apparatus of claim 19, wherein the controller comprises:

a flag checking unit to check a flag indicating the setting of the print region for the previous paper size in the paper cassette if the paper size in the driver is larger than the current paper size in the paper cassette;

a paper rear-end detection unit to detect a time when the rear end of the paper has passed by the paper feeding sensor; and a transfer roller controller to set a separation time of a transfer roller from a transfer belt as a first or second time period based on a time when the rear end of the paper has passed by the paper feeding sensor according to a comparison result of the comparison unit and a checking result of the a flag checking unit and if the time when the rear end of the paper has passed by the paper feeding sensor reaches the separation time of the transfer roller, to separate the transfer roller from the transfer belt.

21. The apparatus of claim 19, wherein the controller comprises:

a flag checking unit to check a flag indicating the setting of the print region for the previous paper size in the paper cassette if the paper size in the drive is larger than the current paper size in the paper cassette;

a paper front-end detection unit to detect a time when the front end of the paper has passed the paper feeding sensor; and a transfer roller controller to set a separation time of a transfer roller from a transfer belt as a first or second time period based on a time when the front end of the paper has passed by the transfer roller according to a comparison result of the comparison unit and a checking result of the a flag checking unit and if the time when the front end of the paper has passed by the transfer roller reaches the separation time of the transfer roller, to separate the transfer roller from the transfer belt.

22. The apparatus of claim 20, wherein the method is applied to a structure of a multipass color image forming apparatus.

23. The apparatus of claim 21, wherein the method is applied to a structure of a multipass color image forming apparatus.

24. The apparatus of claim 20, wherein the first time period is set when the paper size in the driver is equal to or smaller than the current paper size in the paper cassette, or when the paper size in the driver is larger than the current paper size in the paper cassette and the print region for the previous paper size in the paper cassette has been set and is determined according to a distance between the paper feeding sensor and the transfer roller and a printing speed.

25. The apparatus of claim 20, wherein the second time period is set when the paper size in the driver is larger than the current paper size in the paper cassette and the print region for the previous paper size in the paper cassette has not been set and is determined according to a distance between the paper feeding sensor and the transfer roller and a printing speed and in consideration of a delay time when the transfer roller is mechanically separated from the transfer belt after a separation command is applied to the transfer roller.

26. The apparatus of claim 21, wherein the first time period is set when the size of the paper is larger than the size of the image and according to a length of the paper, a length of the image, a length of an upper end page margin, and a printing speed.

27. The apparatus of claim 21, wherein the second time period is set when the paper size in the driver is larger than the current paper size in the paper cassette and the print region for the previous paper size in the paper cassette has not been set and is determined according to the length of the paper, a length of a lower end page margin, and a printing speed.

28. The apparatus of claim 27, wherein the second time period is determined in consideration of the delay time when the transfer roller is mechanically separated from the transfer belt after the separation command is applied to the transfer roller.

29. A multipass color image forming system comprising a controller adapted to perform the following operations:

setting a print region for a scanning operation according to a comparison result between a previous paper size in a paper cassette and a paper size in a driver;

determining a current paper size in the paper cassette based on a time when front and rear ends of the paper are detected by a paper feeding sensor;

comparing the current paper size in the paper cassette with the paper size in the driver; and if the paper size in the driver size is larger than the paper size in the paper cassette and the print region for the previous paper size in the paper cassette has not been set, determining a separation time of a transfer roller from a transfer belt in consideration of a delay time when the transfer roller is mechanically separated from the transfer belt after a separation command is applied to the transfer roller.

30. A method of preventing contamination of a transfer roller in an image forming system, the method comprising:

setting a print region for a scanning operation according to a comparison result between a previous paper size in a paper cassette and a paper size in a driver;

detecting a current paper size in the paper cassette using a paper size detector;

comparing the detected current paper size in the paper cassette with the paper size in the driver; and if the paper size in the driver is larger than the paper size in the paper cassette and the print region for the previous paper size in the paper cassette has not been set, determining a separation time of a transfer roller from a transfer belt in consideration of a delay time when the transfer roller is mechanically separated from the transfer belt after a separation command is applied to the transfer roller.

31. The method of claim 30, wherein if information on the previous paper size in the paper cassette does not exist or the previous paper size in the paper cassette is equal to or larger than the paper size in the driver, the print region for the paper size in the driver is set.

32. The method of claim 30, wherein if the previous paper size the paper cassette is smaller than the paper size in the driver, the print region for the previous paper size the paper cassette is set.

33. An apparatus to prevent contamination of a transfer roller in an image forming system, the apparatus comprising:

a storage unit to store a previous paper size in a paper cassette;

a print region setting unit to set a print region for a scanning operation according to a comparison result between the previous paper size in the paper cassette and a paper size in a driver;

a paper size determination unit to determine a current paper size in the paper cassette;

a comparison unit to compare the current paper size in the paper cassette with the paper size in the driver; and a controller to determine a separation time of a transfer roller from a transfer belt in consideration of a delay time when the transfer roller is mechanically separated from the transfer belt after a separation command is applied to the transfer roller, according to a comparison between the paper size in the driver and the current paper size in the paper cassette and the print region for the scanning operation.

* * * * *